US008826881B2

(12) United States Patent
Laimboeck

(10) Patent No.: US 8,826,881 B2
(45) Date of Patent: Sep. 9, 2014

(54) ENGINE AND CYLINDER WITH GAS EXCHANGE THROUGH THE CYLINDER WALL

(75) Inventor: Franz J. Laimboeck, Goleta, CA (US)

(73) Assignee: Mahle Koenig Kommanditgesellschaft GmbH & Co. KG, Rankweil (AT)

( * ) Notice: Subject to any disclaimer, the term of this patent is extended or adjusted under 35 U.S.C. 154(b) by 0 days.

(21) Appl. No.: 13/604,841

(22) Filed: Sep. 6, 2012

(65) Prior Publication Data

US 2013/0220264 A1 Aug. 29, 2013

Related U.S. Application Data

(60) Provisional application No. 61/531,398, filed on Sep. 6, 2011.

(51) Int. Cl.

| | |
|---|---|
| ***F02F 11/00*** | (2006.01) |
| ***F02F 1/00*** | (2006.01) |
| ***F02B 25/08*** | (2006.01) |
| ***F02B 75/28*** | (2006.01) |
| *F02B 23/10* | (2006.01) |
| *F02B 23/08* | (2006.01) |
| *F02F 1/24* | (2006.01) |

(52) U.S. Cl.

CPC ..... *F02F 1/00* (2013.01); *F02B 2275/22* (2013.01); *F02B 2023/103* (2013.01); *F02B 2023/085* (2013.01); *F02B 25/08* (2013.01); *F02F 2001/245* (2013.01); *F02B 75/282* (2013.01)

USPC ..... 123/193.3; 123/90.31; 123/90.38

(58) Field of Classification Search

CPC ..... F02B 2075/025; F02B 2075/027; F02B 75/28; F02B 75/282; F02F 7/0009; F02F 7/0019; F02F 7/0026

USPC ..... 123/52.2–53.1, 51 A, 51 AA, 51 AC, 123/51 B, 51 BA, 51 BB, 51 BC, 51 BD, 51 R, 123/188.8, 188.2, 193.3, 65 VD, 65 P

See application file for complete search history.

(56) References Cited

U.S. PATENT DOCUMENTS 1,331,911 A * 2/1920 Guy ..... 123/41.77
1,415,374 A * 5/1922 Lovejoy ..... 123/90.44

(Continued)

FOREIGN PATENT DOCUMENTS

WO 0065208 A1 11/2000
WO 01/49980 A1 7/2001

OTHER PUBLICATIONS

Austrian Patent Office, Office Action Dated Jan. 26, 2012.

*Primary Examiner* — Hung Q Nguyen
(74) *Attorney, Agent, or Firm* — Laurence A. Greenberg; Werner H. Stemer; Ralph E. Locher

(57) ABSTRACT

An engine cylinder with a piston and at least one, preferably two or four, cam-operated valves leading to the combustion chamber. A valve seat of the valve is formed in the cylinder wall immediately laterally adjacent to the cylinder bore or to the cylinder chamber. The valve axis and the cylinder axis enclose an acute angle A of 5°≤A≤25°, preferably 10°≤A≤20°. The axis of the inlet channel or the outlet channel leading to the valve seat in a plane defined by the valve axis and the cylinder axis is inclined at an angle B of 25°≤B≤65°, preferably 40°≤B≤50° to the valve axis.

19 Claims, 4 Drawing Sheets

(56) References Cited

U.S. PATENT DOCUMENTS 1,521,440 A * 12/1924 Foster ..... 123/432
2,081,139 A * 5/1937 Beals et al. ..... 123/51 R
4,184,463 A * 1/1980 Koga et al. ..... 123/193.2
4,856,463 A * 8/1989 Johnston ..... 123/51 BA
6,250,263 B1 6/2001 Sisco
6,715,465 B2 4/2004 Hallam

* cited by examiner

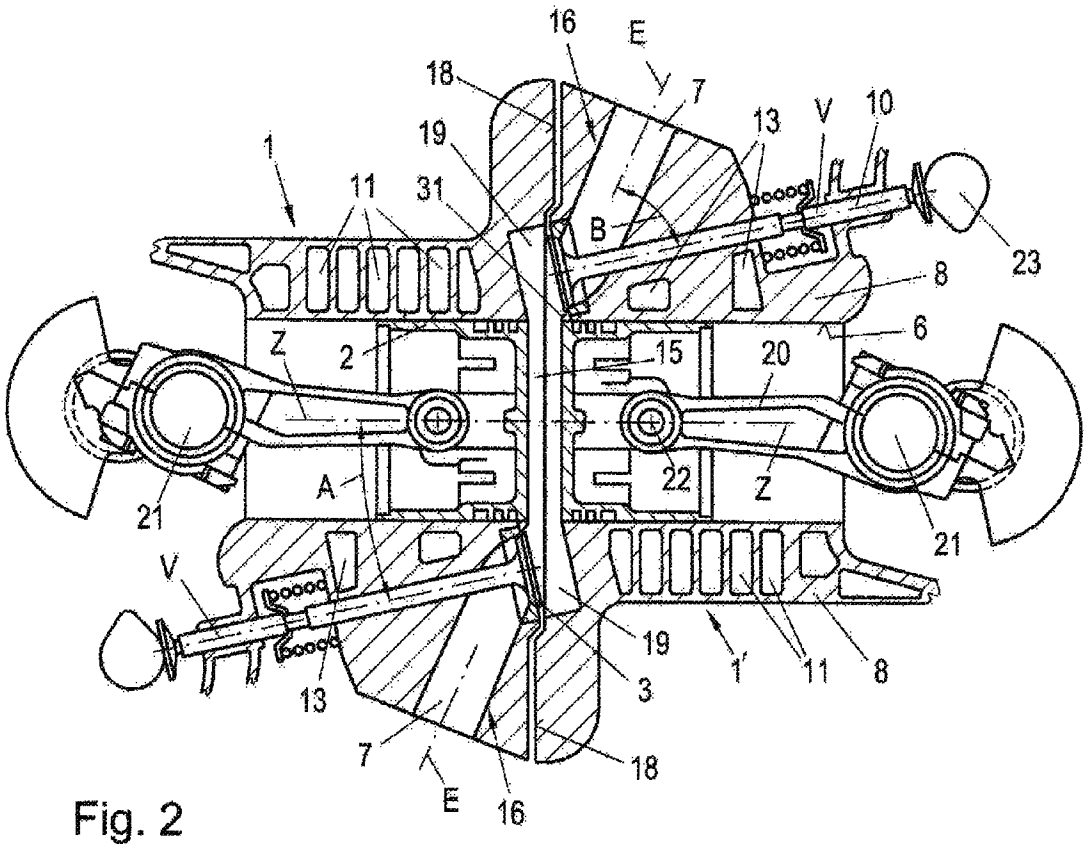
Fig. 2
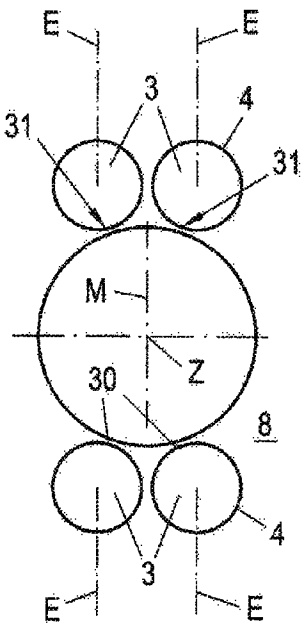

ENGINE AND CYLINDER WITH GAS EXCHANGE THROUGH THE CYLINDER WALL

CROSS-REFERENCE TO RELATED APPLICATION

This application claims the benefit, under 35 U.S.C. §119 (e), of provisional patent application No. 61/531,398 filed Sep. 6, 2011; the prior application is herewith incorporated by reference in its entirety.

BACKGROUND OF THE INVENTION

Field of the Invention

The invention relates to an engine cylinder with a piston and at least one, preferably two or four, cam-controlled valves leading into the combustion chamber, wherein the valve seat of the valve disposed at the end of an inlet channel or outlet channel is formed laterally in the cylinder wall immediately adjacent to the cylinder bore or the cylinder chamber, and the valve axis and the cylinder axis enclose an acute angle of 5° A 25°, preferably 10° A 20°. The invention also pertains to an engine with at least one such cylinder.

SUMMARY OF THE INVENTION

The object of the invention is to make the charge exchange for such engine cylinders efficient and to maintain the efficiency as high as possible. The design of the engine cylinder should also be structurally simple.

These objects are achieved for an engine cylinder of the type mentioned above. Further, the valve axis and the cylinder axis enclose an acute angle A of $5° \leq A \leq 25°$, preferably $10° \leq A \leq 20°$, and the axis of the inlet channel or the outlet channel leading to the valve seat in a plane defined by the valve axis and the cylinder axis is inclined at an angle B of $25° \leq B \leq 65°$, preferably $40° \leq B \leq 50°$, to the valve axis.

The resulting inclination of the valve seat of the valve in relation to the cylinder axis causes an improved inflow of fresh gas, i.e. of air or a fuel-air mixture or a better exhaust of waste gases. In addition there is space in the cylinder wall for the formation of cooling channels. The flow losses are reduced and the torque or the power is improved. The cylinder head is freely accessible and the valve controller is simple to design.

The inflow of fresh gas is supported advantageously if the plane of the channel mouth or of the valve seat is inclined at the angle A to a plane perpendicular to the cylinder axis or if it is provided that the axis of an inflow channel or an outlet channel leading to the valve seat in a plane defined by the valve axis and the cylinder axis is inclined to the valve axis at an angle B of $25° \leq B \leq 65°$, preferably $40° \leq B \leq 50°$.

It is of particular advantage for cooling if at least one channel runs in the cylinder wall in the area between the cylinder bore or the cylinder chamber and the guide for the valve or for the valve tappet.

The inflow and the turbulence of the fresh gas are supported advantageously if it is provided that the inflow channel or the outlet channel has a straight section ending before its opening into the combustion chamber or before the valve seat, whose length corresponds to 1.0 to 5 times, preferably 2 to 4 times, its diameter and/or if the area close to the cylinder chamber, which is adjacent to the valve seat, is rounded and the rounding has a radius of 2 to 6 mm.

In order to achieve high compression, it can be provided that the combustion chamber spans only the valve seat region and the region of the cylinder chamber close to the valve seat, being preferably 30% to 70%, in particular 40% to 60%, of the entire cross-sectional area of the cylinder chamber.

It is of advantage if at least one ignition unit is arranged in the cylinder head, which advantageously lies opposite the area between the cylinder chamber and the valve seat. This benefits the ignition characteristics of such a cylinder.

It is possible to design the cylinder in such a way that two mutually diametrically opposed valves are arranged in the cylinder wall and the cylinder with the valves has a design that is symmetrical relative to a plane through the cylinder axis and the two valve axes. It is also possible that two mutually opposed pairs of valves are arranged in the cylinder wall and the cylinder and the pairs of valves are centrally symmetrical relative to the cylinder axis.

It is advantageous for operation if at least one ignition unit and/or at least one fuel supply unit, preferably an injection unit, protrudes into the combustion chamber and/or if the inner wall surface of the cylinder head in the central region of the cylinder bore or in the region of the cylinder axis is just at or near the level of the piston surface at the top dead center position and/or if in the case of the arrangement of two valves or two pairs of valves along the periphery of the cylinder, one valve or pair of valves closes the inflow opening(s) for fresh gas and the other valve or pair of valves closes the outflow opening(s) for the exhaust gases.

In the case of an opposed piston engine with two engine cylinders according to the invention, which are joined at their end faces nearer the combustion chamber and thus form a whole cylinder, in which two pistons are mounted so as to be movable up and down in opposition, it is provided according to the invention that at least one recess is formed in the cylinder wall or in the end face of the respective cylinder, which recess is opposite the respective valve, which is formed in the cylinder wall or in the end face of the respective other cylinder.

The combustion characteristics and the charge exchange are benefited for such an engine. It is also provided that the recess communicates with the cylinder chamber or forms a single combustion chamber with it.

In the case of the engine cylinder according to the invention, the charge exchange takes place advantageously through the cylinder wall or through a wall portion bounding the cylinder chamber. This is a laterally controlled valve arrangement with a valve axis inclined relative to the cylinder axis.

Other features which are considered as characteristic for the invention are set forth in the appended claims.

Although the invention is illustrated and described herein as embodied in a gas exchange through the cylinder wall, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 2 shows an opposed piston engine with a whole cylinder formed with engine cylinders according to the invention.

DETAILED DESCRIPTION OF THE INVENTION

Figure 1:
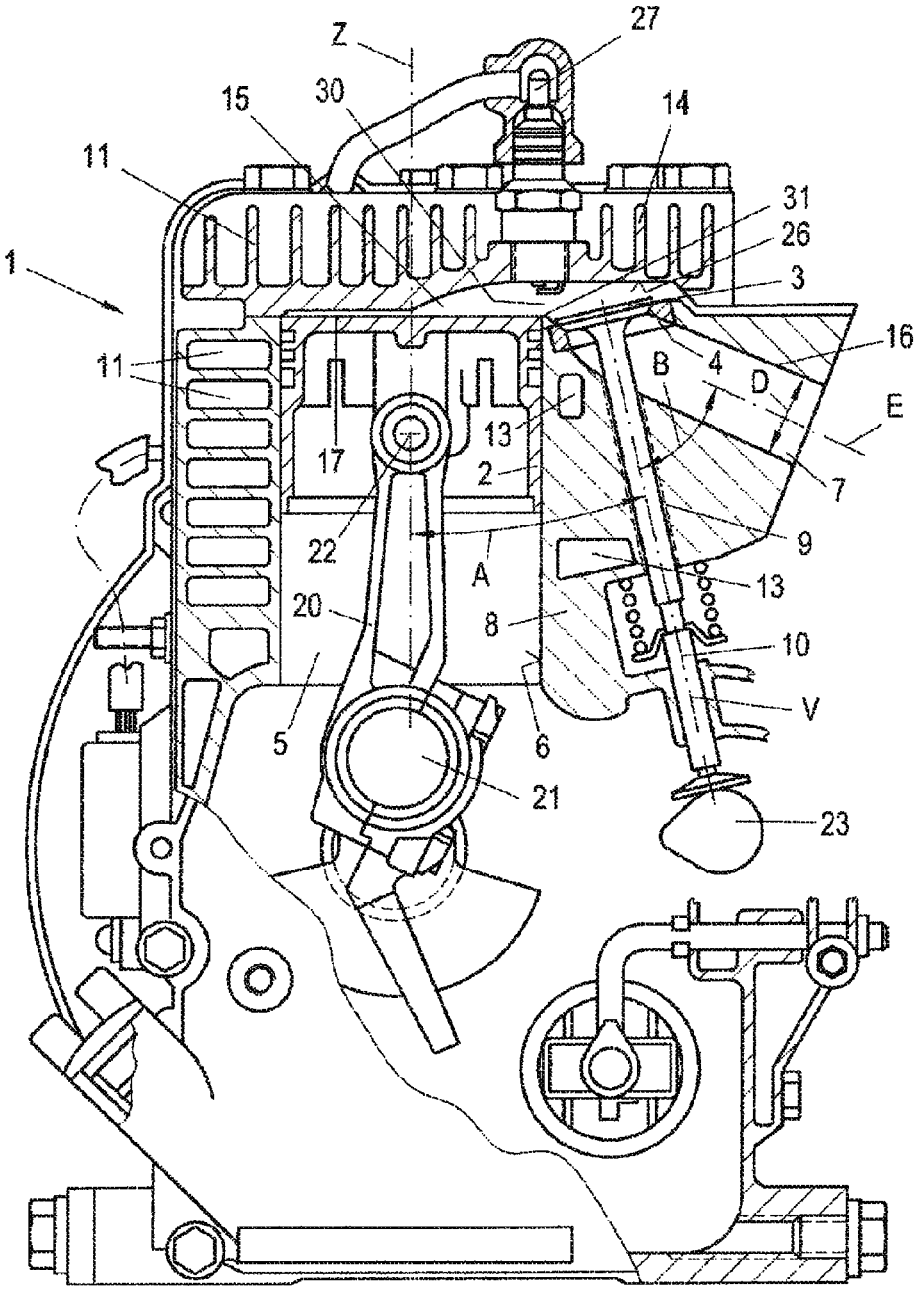
FIG. 1 shows a schematic section through an engine cylinder with a laterally controlled valve arrangement.

FIG. 1 shows an engine cylinder 1, in which a piston 2 is mounted so as to be movable up and down. The piston 2 is connected to a crankshaft via a gudgeon pin 22 and a connecting rod 20 with a crank offset 21. A number of cooling recesses and channels 11 are formed in the cylinder wall 8 and a valve seat 4 for a valve 3 is formed immediately adjacent to the upper end region of the cylinder bore 6. The valve 3 is guided in a guide 9 and is operated by a camshaft 23 via a valve tappet 10. In the present case the valve 3 is an inflow valve for fresh gas, i.e. air or a fuel-air mixture, which closes the opening of an inflow channel 7.

The valve axis V of the valve 3 encloses an acute angle A with the cylinder axis Z, wherein $5° \leq A \leq 25°$, preferably $10° \leq A \leq 20°$.

This design has the advantage that it is possible to arrange additional cooling channels 13 in the cylinder wall 8. The inclination of the valve axis V further provides the possibility of introducing fresh gas into the combustion chamber 15 very efficiently. The fresh gas is made turbulent at the edge 31 of the inflow channel 7, which is close to the cylinder chamber 5. This edge 31 is implemented in rounded form and as a result there are low flow losses and a good mixture of a supplied fuel-air mixture or of supplied air with injected fuel.

It is further provided that the axis E of an inflow channel or an outlet channel 7 leading to the valve seat 4 in a plane defined by the valve axis V and the cylinder axis Z is inclined to the valve axis V at an angle B of $25° \leq B \leq 65°$, preferably $40° \leq B \leq 50°$. This measure reduces the charge exchange losses and improves mixing.

The inlet or outlet channel 7 comprises a straight section 16 ending before its opening into the combustion chamber 15 or before the valve seat 4, whose length corresponds to 1.0 to 5 times, preferably 2 to 4 times, its diameter D.

The combustion chamber 15 extends only over a portion of the cross-section of the cylinder chamber 5, and the region of the cylinder head 5 remote from the valve can be very close to the position of the piston face 17 at the top dead center position, in order to be able to configure a high compression ratio of the engine cylinder 1.

At least one ignition unit 27 is arranged in the cylinder head 14 and is opposite the region 30 between the cylinder chamber 5 and the valve seat 4. At least one cooling channel 13 runs in the cylinder wall 8 in the region between the cylinder bore 6 or the cylinder chamber 5 and the guide 9 for the valve 3 and/or for the valve tappet 10.

It is possible that two mutually diametrically opposed valves 3 are arranged in the cylinder wall 8 and the cylinder 1 with the valves 3 has a structure that is symmetrical to a plane running through the cylinder axis Z and the two valve axes V. Alternatively, two mutually opposed pairs of valves 3 can be arranged in the cylinder wall 8 and the cylinder 1 and the pairs of valves 3 can be arranged in a mirror-image disposition relative to a central plane M.

Only one valve 3 is illustrated in FIG. 1, which has a valve axis V situated in the same plane as the cylinder axis Z, wherein this plane can represent a plane of symmetry for the cylinder. However, it is also possible that in the case of the arrangement of two valves 3 or two pairs of valves along the periphery of the cylinder 1, a valve or a pair of valves is connected to the fresh gas supply and the respective other valve or pair of valves closes the outflow opening for exhaust gases.

FIG. 2 illustrates the assembly of two engine cylinders 1, 1' according to the invention, which are joined or connected to each other along their end faces 18 and form an opposed piston engine. The valves 3 disposed in the cylinders 1, 1' or their cylinder walls 8 are arranged opposite a recess 19 in the respective other cylinder in each case, the recess enabling a good inflow or outflow of the fuel-air mixture or exhaust gas to be delivered or exhausted through the respective channel 7 into or out of the combustion chamber 15.

The arrangement of the cylinders 1, 1' and the valves 3 is centrally symmetrical relative to the longitudinal axis Z of the two joined cylinders 1, 1'. It is also of advantage with this embodiment if cooling channels 13 are formed in the cylinder wall 8 in the space between the valve guides 9 and the cylinder bore 6.

In FIG. 2 on the left is schematically illustrated how two pairs of valves 3 in each case are arranged in the cylinder wall 8 on both sides of the cylinder chamber 5, i.e. there are two inlet and two outlet valves, each of which with its valve axes V encloses an acute angle A with the cylinder axis Z.

It is also possible to have 3 valves, or the inlet and outlet valves can be of different sizes. In the case of 2-stroke engine cylinders, the required symmetry of the cylinder 1 is to be noted. In the case of 2-stroke engines, all the valves provided can be outlet valves.

Air or a fuel-air mixture can be supplied through the inflow channels 7. If air is supplied, a fuel supply or fuel injection takes place into the combustion chamber 15, especially close to a valve 3.

Figure 3:
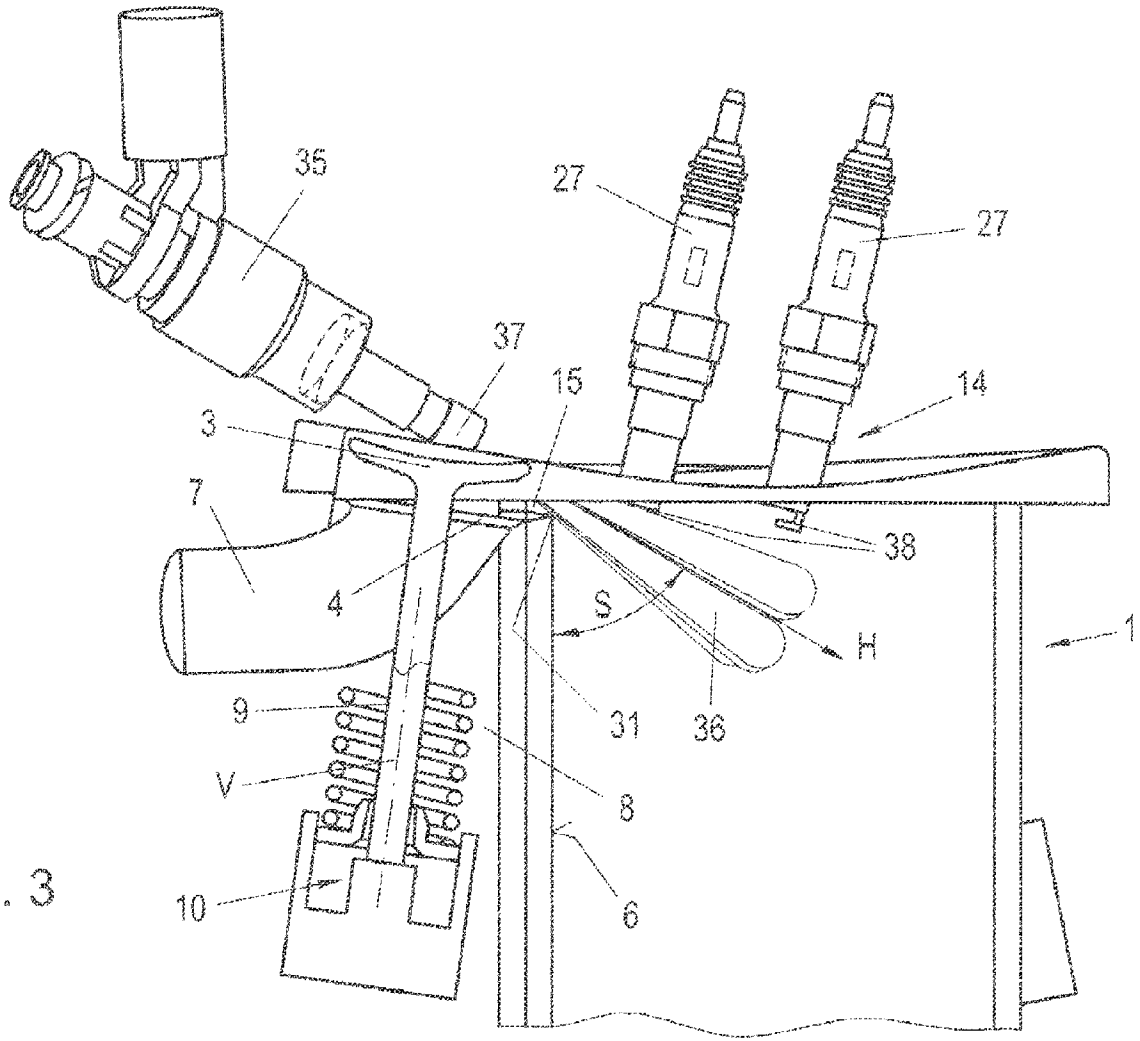
FIG. 3 shows an embodiment of a cylinder according to the invention.

FIG. 3 shows an embodiment of an engine cylinder according to the invention, for which a fuel injection device 35 is provided, with which fuel in the form of fuel jets 36 is delivered towards the provided ignition units 27 or to the ignition electrodes 38 supported by the ignition units 27. The injection nozzles 37 are disposed in the area close above or between the valves 3 or their valve seats 4, especially if there are two valves 3 arranged close to each other. It is also possible to arrange the injection nozzles 37 in proximity to the valve axis V extended out beyond the valve disk.

This embodiment is an optimized embodiment in relation to the inflow or outflow channel 7. With the embodiment illustrated in FIG. 3, a direct injection nozzle 37 is arranged in the region of the inflow channel 7 and a double ignition takes place, wherein the ignition electrodes 38 are oriented in series or one after the other in the direction of the injection jets 36. In the case of a high inflow rate or tumbling charge motion, the injection jets 36 are forced towards the combustion chamber wall and thus the ignition electrode 38 remote from the injection nozzle 37 is also struck by the injection jets 36. It is of advantage with this embodiment if the ignition plugs have a multiple ignition. The ignition plugs 27 sit in a cylinder head that is not illustrated but is only indicated in FIG. 3.

The acute angle S between the inner wall surface 6 of the cylinder 1 and the main flow direction H of the injection nozzle 27 has a magnitude of approximately 50 to 70°.

Figure 4:
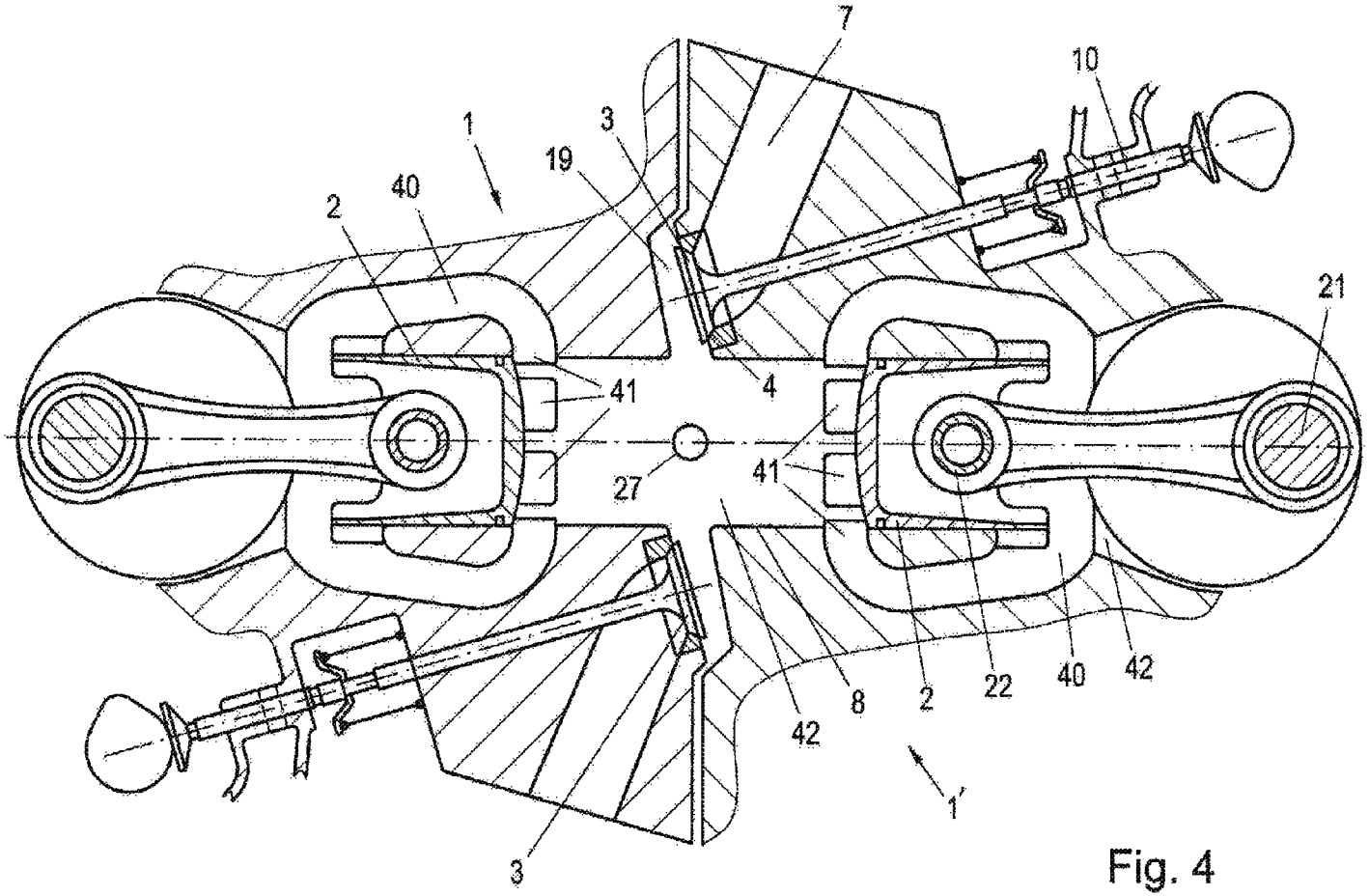
FIG. 4 shows an embodiment of an opposed piston engine, preferably in the form of a 2-stroke engine.

FIG. 4 shows a schematic section of an embodiment of an opposed piston engine, which is similar to that illustrated in FIG. 2. The two valves 3 are used here to close outlet channels 7; overflow windows 41 are formed in the cylinder wall 8 in the area close to bottom dead center and are supplied by overflow channels 40, which communicate with the crankcase 42 and pre-compressed mixture flows from the crankcase 42 into the cylinder chamber 42. The ignition unit 27 lies in the central plane between the two individual cylinders 1, 1' joined to form the whole cylinder 1. This engine is of symmetrical construction relative to a plane perpendicular to the gudgeon pin 22. This opposed piston engine is operated as a 2-stroke engine.

The invention claimed is:

1. An engine cylinder, comprising:

a piston and at least one cam-controlled valve leading into a combustion chamber, wherein a valve seat of the valve disposed at an end of an inlet channel or outlet channel is formed laterally in a cylinder wall immediately adjacent to a cylinder bore or a cylinder chamber;

a valve axis and a cylinder axis, in a projection view, enclosing an acute angle A of $10° \leq A \leq 20°$; and the inlet or outlet channel including a straight section leading to, and ending directly at, the valve seat of the valve, an axis of the straight section of the inlet channel or outlet channel leading to the valve seat being inclined at an angle B of $25° \leq B \leq 65°$ to the valve axis; and the straight section having a length corresponding to 1 to 5 times a diameter thereof and being averted away from the cylinder wall.

2. The engine cylinder as claimed in claim 1, wherein the angle B is $40° \leq B \leq 50°$.

3. The engine cylinder as claimed in claim 1, wherein at least one cooling channel runs in the cylinder wall in a region between the cylinder bore or the cylinder chamber and the guide for the valve or for the valve tappet.

4. The engine cylinder as claimed in claim 1, wherein the length of the straight section of the inlet or outlet channel amounts to 2 to 4 times its diameter.

5. The engine cylinder as claimed in claim 1, wherein at least one ignition unit is arranged in the cylinder head and lies opposite the region between the cylinder chamber and the valve seat.

6. The engine cylinder as claimed in claim 1, wherein an area close to the cylinder chamber, and which is adjacent the valve seat, is rounded, wherein the rounding has a radius of 2 to 6 mm.

7. The engine cylinder as claimed in claim 1, wherein two mutually diametrically opposed valves are arranged in the cylinder wall and the cylinder with the valves has a structure that is symmetrical relative to a plane passing through the cylinder axis and the two valve axes or that two mutually opposed pairs of valves are arranged in the cylinder wall and the cylinder and the pairs of valves are formed as a mirror image relative to a central plane perpendicular to a crankshaft of the engine.

8. The engine cylinder as claimed in claim 1, wherein at least one ignition unit and/or at least one fuel supply unit protrudes into the combustion chamber and/or that an inner wall surface of the cylinder head in the central region of the cylinder bore or in the region of the cylinder axis is just at or close to a level of the piston face at a top dead center position.

9. The engine cylinder as claimed in claim 8, wherein the at least one fuel supply unit is an injection unit.

10. The engine cylinder as claimed in claim 1, wherein in the case of the arrangement of two valves or two pairs of valves along the periphery of the cylinder, one valve or a pair of valves is connected to a fresh gas supply and the other valve or pair of valves closes an outflow opening for exhaust gases.

11. The engine cylinder as claimed in claim 1, wherein a recess in the respective engine cylinder communicates with the cylinder chamber and the combustion chamber of the engine cylinder.

12. The engine cylinder as claimed in claim 1, wherein an injection nozzle of a fuel injector is located in the region in front of and/or above a valve(s) or valve seat(s) or in the space between or above two adjacent valves or valve seats, wherein the injection direction is towards ignition electrodes of at least one ignition unit.

13. An engine, comprising at least one engine cylinder as claimed in claim 1.

14. The engine according to claim 13 configured as a two-stroke engine.

15. An opposed piston engine, comprising two engine cylinders as claimed in claim 1, which are joined at their end faces on a combustion chamber side and form a whole cylinder, in which two pistons are movable up and down in opposition, wherein at least one recess is formed in the cylinder wall or in an end face of each cylinder, the recess lying opposite the respective valve that is formed in the cylinder wall or in the end face of the respective other cylinder.

16. The engine according to claim 15 configured as a two-stroke opposed piston engine.

17. An opposed piston engine, comprising two engine cylinders as claimed in claim 1, which are joined at their end faces on a combustion chamber side and form a whole cylinder, in which two pistons can move up and down in opposition, wherein overflow windows are formed in the cylinder wall in a region of a bottom dead center position of the two pistons, that an ignition unit is arranged in a longitudinal central region of the whole cylinder and that valves close outlet channels or the channels lead to an exhaust.

18. The engine according to claim 17 configured as a two-stroke opposed piston engine.

19. The engine cylinder according to claim 1, wherein said valve is one of a plurality of cam-controlled valves.

* * * * *